US005745963A

United States Patent [19]

Graziano

[11] Patent Number: 5,745,963

[45] Date of Patent: May 5, 1998

[54] ADJUSTABLE FASTENING DEVICE FOR SPORTS FOOTWEAR

[75] Inventor: Nicoletti Graziano, Treviso, Italy

[73] Assignee: Canstar Italia S.p.A., Montebelluna, Italy

[21] Appl. No.: 678,179

[22] Filed: Jul. 11, 1996

[51] Int. Cl.[6] ..... A43C 11/00

[52] U.S. Cl. ..... 24/685 K

[58] Field of Search ..... 24/685 K, 68 R, 24/695 K, 705 K, 715 K

[56] References Cited

U.S. PATENT DOCUMENTS

| | | | |
|---|---|---|---|
| 4,547,980 | 10/1985 | Olivieri | 24/71 SK |
| 5,172,454 | 12/1992 | Martignago | 24/71 SK |
| 5,357,690 | 10/1994 | Ho | 24/68 SK |

*Primary Examiner*—James R. Brittain
*Attorney, Agent, or Firm*—Sugrue, Mion, Zinn, Macpeak & Seas, PLLC

[57] ABSTRACT

The device comprises a ratchet (3) and a base (4) that are to be respectively secured to the two footwear portions (A, B) to be closed on one another, a sprocket wheel (12) supported on the base (4) to be rotatable about an axis substantially perpendicular to the sliding direction of the ratchet (3), a lever (8) mounted on the base (4) so that it can be swung about the axis of the sprocket wheel (12), as well as first (13, 15) and second, (26) unidirectional retainers means respectively between the lever (8) and the sprocket wheel (12), for the rotation of the sprocket wheel and the resultant sliding in one direction of the ratchet (3), and for holding the ratchet with respect to the base (4) in the opposite direction; the first unidirectional retaining means comprises a coupling having front teeth (13, 15), which coupling acts between one axial end of the sprocket wheel and the lever.

18 Claims, 6 Drawing Sheets

ADJUSTABLE FASTENING DEVICE FOR SPORTS FOOTWEAR

BACKGROUND OF THE INVENTION

The present invention relates to an adjustable fastening device for sports footwear, for closing with respect to one another two footwear portions that can be moved relative to one another, of the type comprising:

- a ratchet that is to be secured to one of the footwear portions,
- a base that is to be secured to the other of the footwear portions, the ratchet being slidable in a predetermined direction with respect to the base,
- a sprocket wheel supported on the base to be rotatable about an axis that is substantially perpendicular to the sliding direction of the ratchet, the sprocket wheel being in meshing engagement with the ratchet,
- a lever mounted on the base so that it can be swung about the axis of the sprocket wheel,
- first unidirectional retaining means between the lever and the sprocket wheel for the rotation of the sprocket wheel and the resultant sliding in one direction of the ratchet as a result of the swinging of the lever into an operative position,
- second unidirectional retaining means for holding the ratchet with respect to the base in the opposite direction to the sliding direction.

A device including these characteristics is known from French Patent Application No. 2527463 in the name of Icaro Olivieri & C. S.p.A.

That device has the special feature of permitting an advance of the ratchet, for each operation of the lever, by a distance greater than the pitch between two contiguous ratchet teeth.

The device also prevents the operation of the ratchet when the lever is returned to the non-operative position, near the base. Despite these considerable advantages the device known from the above-mentioned French patent has the disadvantage that it has an undesirably large space requirement and that the proposed ratchet gear for the unidirectional stopping of the sprocket wheel acts directly on the toothed portion of the sprocket wheel with possible consequent damage to the teeth which engage with the ratchet.

SUMMARY OF THE INVENTION

The principal aim of the present invention is to provide a fastening device that is designed structurally and functionally to avoid all the disadvantages described with reference to the mentioned prior art.

This aim is achieved by the invention by means of a fastening device produced in accordance with the claims which follow.

BRIEF DESCRIPTION OF THE DRAWINGS

The characteristics and advantages of the invention will become clear from the detailed description of two of its preferred embodiments described, by way of non-limiting example, with reference to the appended drawings in which.

DETAILED DESCRIPTION OF THE INVENTION

Figure 1:
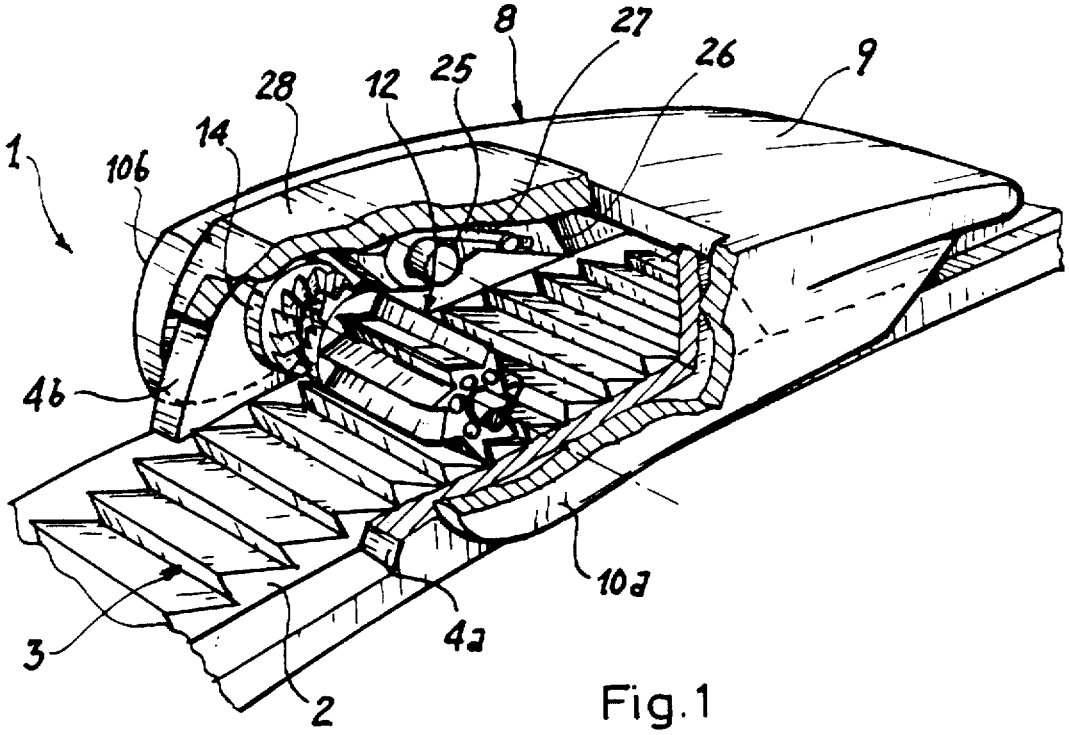
FIG. 1 is a perspective view, partly in section, of a first example of the fastening device according to the invention.
Figure 2:
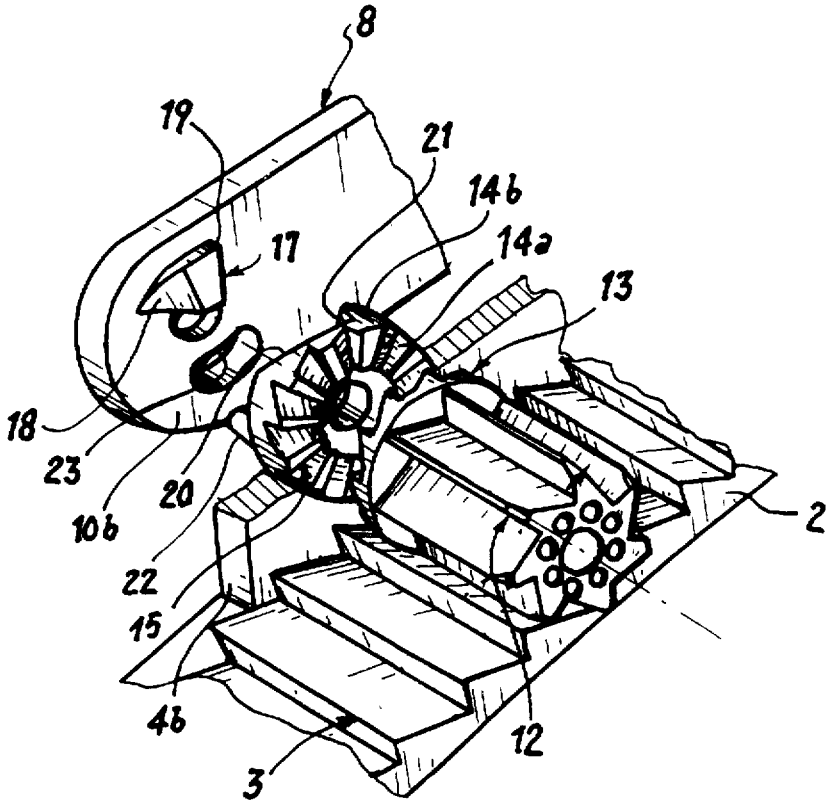
FIG. 2 is an exploded perspective view of a detail of the fastening device of FIG. 1.

In FIGS. 1 to 9, a first example of the fastening device produced in accordance with the present invention and intended to close two footwear portions which are respectively designated A and B and can be moved with respect to one another is generally indicated 1. The device 1 comprises a flexible strap 2, preferably produced from plastics material, which is to be secured to footwear portion A and which has a plurality of parallel teeth which together constitute a ratchet 3 having a saw-tooth profile.

Secured to footwear portion B, on the other hands is a substantially U-shaped base 4 having two parallel wings 4*a*, *b* and a central portion 4*c*. The central portion 4*c* has a hole 5 by way of which the base 4 is secured to portion B by rivets or similar means. The wings 4*a*,*b* have respective holes 6, 7, the hole 7 being wider than the hole 6 for the reasons explained hereinafter.

A lever 8, having a control appendage 9 from which two parallel arms 10*a*,*b* extend, is pivoted by means of its arms 10*a*,*b* on a pivot pin 11 extending through the holes 6, 7. The arms 10*a*,*b* are arranged along the outside of the corresponding wings 4*a*,*b*.

A sprocket wheel 12 with an external toothed portion having a pitch such that it meshes with the toothed portion of the ratchet 3 is rotatably supported on the pivot pin 11. The sprocket wheel 12 can be moved axially on the pivot pin 11 and has, at one of its axial ends, a first front coupling element 13, the toothed portion of which has a saw-tooth profile.

A flange 14 which is interposed between the sprocket wheel 12 and the arm 10*b* of the lever and which has opposing front surfaces 14*a*,*b* is also rotatably supported on the pivot pin 11. The flange 14 can be moved axially on the pivot pin 11 and is housed in the hole 7.

A second front coupling element 15 is formed on the surface 14*a* of the flange 14 and can engage with the first element 13 for the reasons explained hereinafter.

The first and second coupling elements 13, 15 are resiliently urged to disengage from one another by a spring 16 fitted on the pivot pin 11 and acting between the sprocket wheel 12 and the flange 14.

A cam 17 having a ramp 18 which is inclined with respect to a face 19 substantially at right-angles to the plane defined by the surface of the arm 10*b* projects from the internal surface, facing the flange 14, of the arm 10*b*.

Formed on the surface 14*b* of the flange, facing the arm 10*b* of the lever, are a counter-ramp 20 and a shoulder 21, which members can engage with the cam 17 for the operative control of the coupling having front teeth as will be explained hereinafter.

Figure 8:
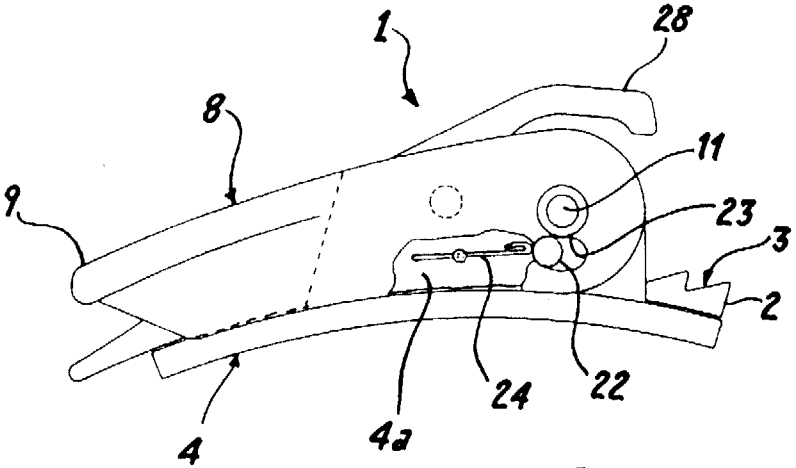
FIG. 8 is a side elevation of the fastening device in the position of FIG. 3.
Figure 10:
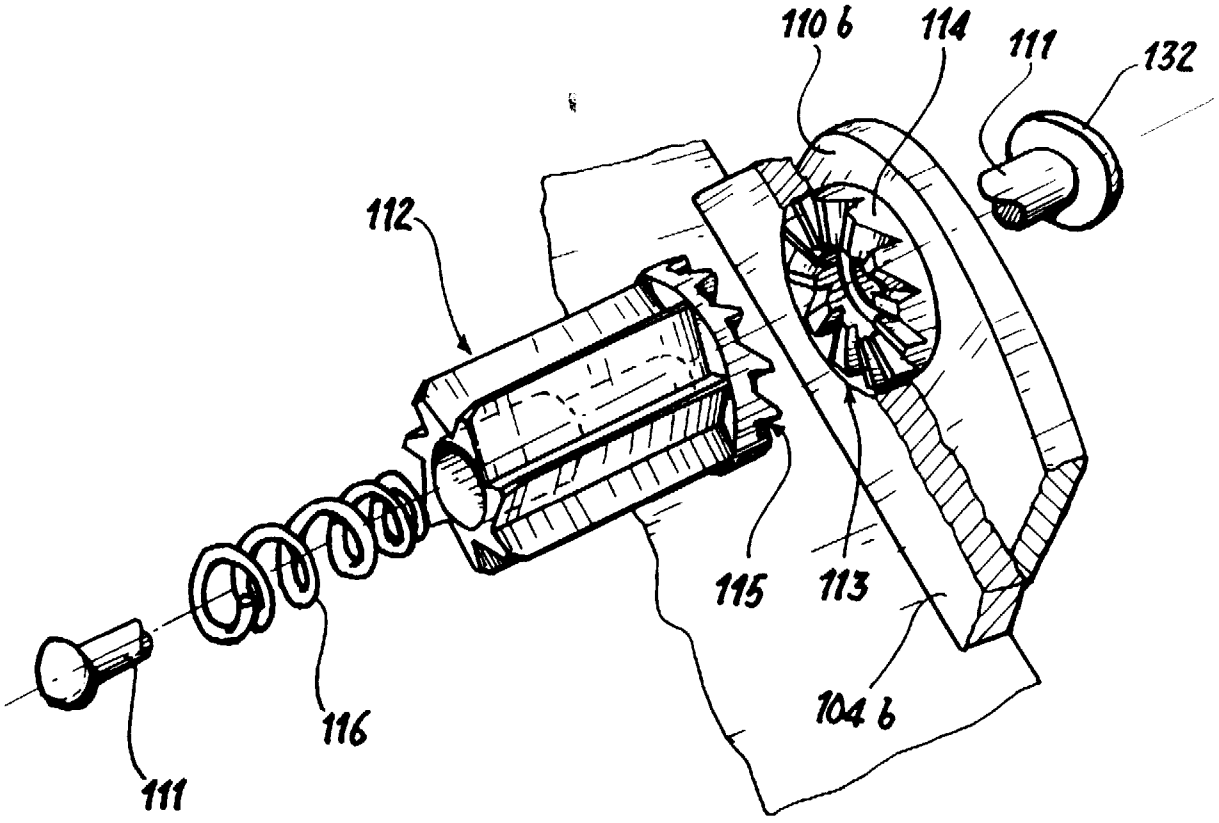
FIG. 10 is an exploded perspective view of a detail of a second example of the fastening device according to the invention.

A peg 22 extends from that surface 14*b* and can slide to a limited extent in a slot 23 passing through the arm 10*b* and extending in the circumferential direction with respect to the pivot axis of the lever. 24 indicates a sprung element having one end attached to the wing 4*b* of the base and an opposing free end which rests against the peg 22 when the lever 8 is in the non-operative position of FIG. 8.

As will be explained in detail hereinafter, the sprocket wheel 12 is caused to rotate about the axis of the pivot pin 11 by operating the lever 8 in the direction and sense of arrow C of FIG. 4 while it remains idle when the lever is returned to the non-operative position of FIG. 3 in the opposite sense to that of arrow C.

When the strap 2 is interposed between the central portion 4*c* of the base 4 and the sprocket wheel 12, in engagement with the ratchet 3, a rotation of the lever 8 in the direction and sense of arrow C causes the ratchet to move in the direction and sense of arrow E with the coupling elements 13, 15, which constitute first unidirectional retaining means, acting by way of the sprocket wheel 12 on the ratchet 3.

A pawl 26 resiliently urged by a spring 27 into meshing engagement with the teeth of the ratchet 3 is pivoted between the wings 4*a,b* of the base 4 by means of a pivot pin 25. The pawl 26 can be swung out of engagement with the ratchet 3 by exerting a suitable pressure on a control appendage 28 thereof. The pawl 26 constitutes a second unidirectional retaining means for holding the ratchet in order to prevent it from sliding with respect to the base in the opposite direction to that of arrow E. It will be noted that the position of the pawl 26 relative to the lever 8 is such that the respective pivot axes are parallel and spaced in such a manner that the space requirements of the pawl and the lever overlap at least partially when the lever 8 is in the non-operative position of FIG. 3 near the base 4.

When the portions A and B of the footwear are to be closed, the strap 2 is first of all inserted with the ratchet 3 between the wings 4*a,b* of the base 4 and also between the central portion 4*c* of the base and the sprocket wheel 12.

Figure 3:
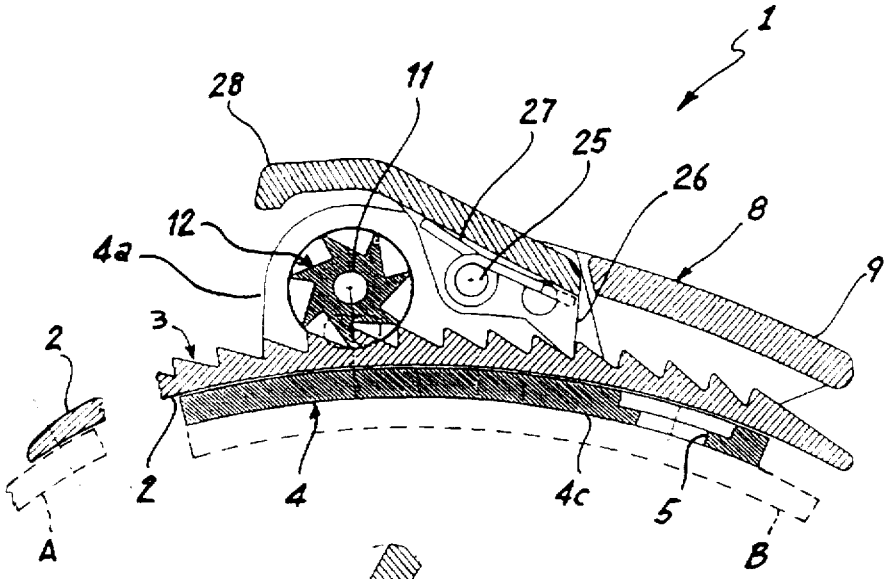
FIG. 3 is a cross-sectional view of the fastening device of FIG. 1 with the lever in the non-operative position.
Figure 4:
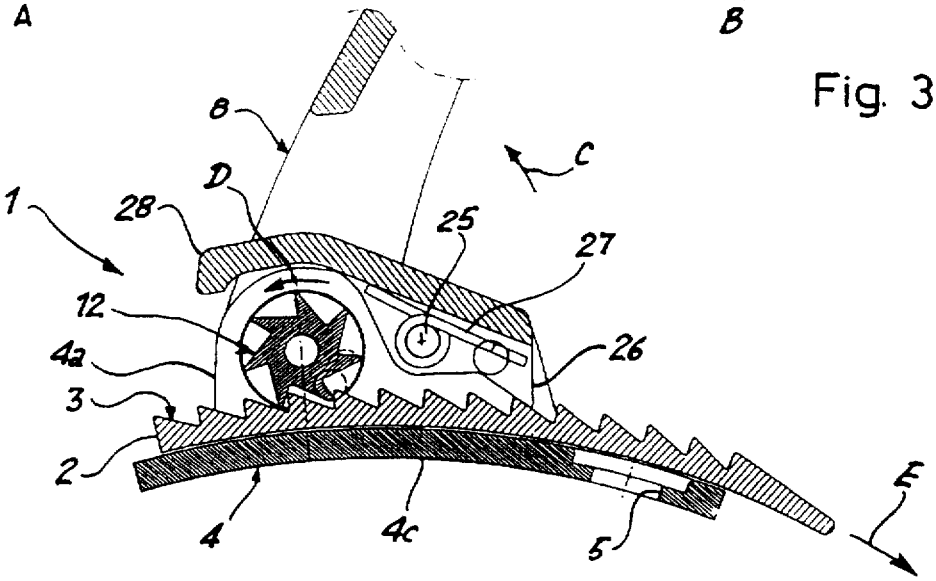
FIG. 4 is a view corresponding to that of FIG. 1 after the lever has been moved into the operative position.
Figure 5:
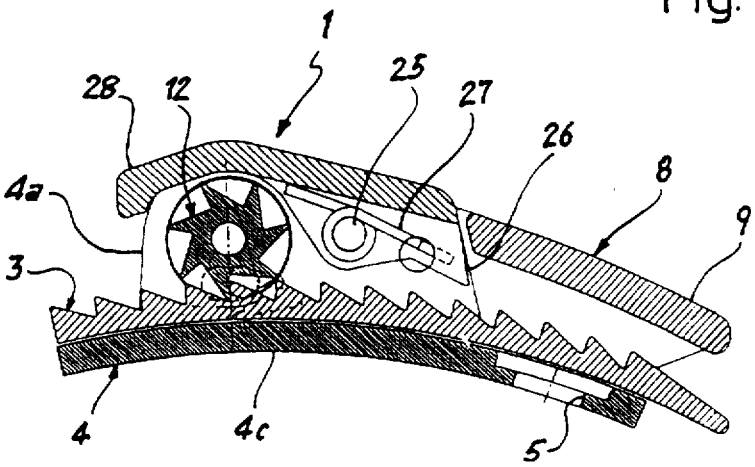
FIG. 5 is a sectional view corresponding to FIG. 1 with the fastening released.
Figure 6:
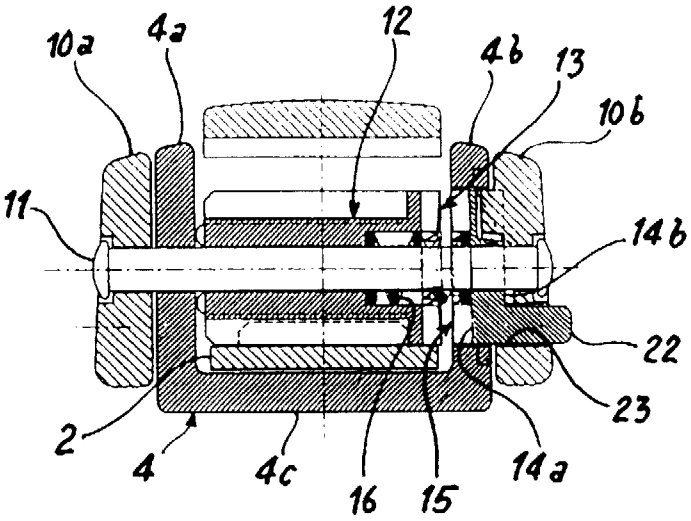
FIGS. 6 and. 7 are front views of the fastening device in the positions of FIGS. 3 and 4, respectively.

The lever 8 is in this phase maintained in the non-operative position of FIG. 3, folded onto the base 4. In this phase., the cam 17 is received in the recess between the counter-ramp 20 and the shoulder 21, enabling the spring 16 to maintain the coupling elements uncoupled, with the sprocket wheel 12 idle about the pivot axis.

Figure 9:
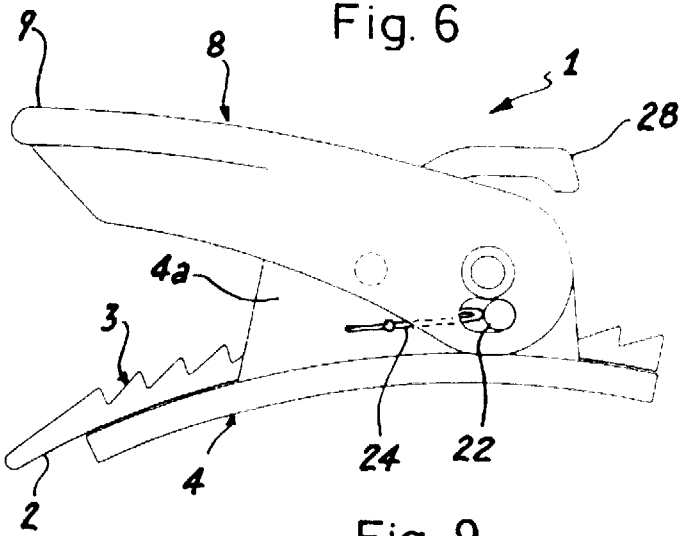
FIG. 9 is a side elevation of the fastening device of FIG. 1 after partial movement of the lever towards the operative position.
Figure 7:
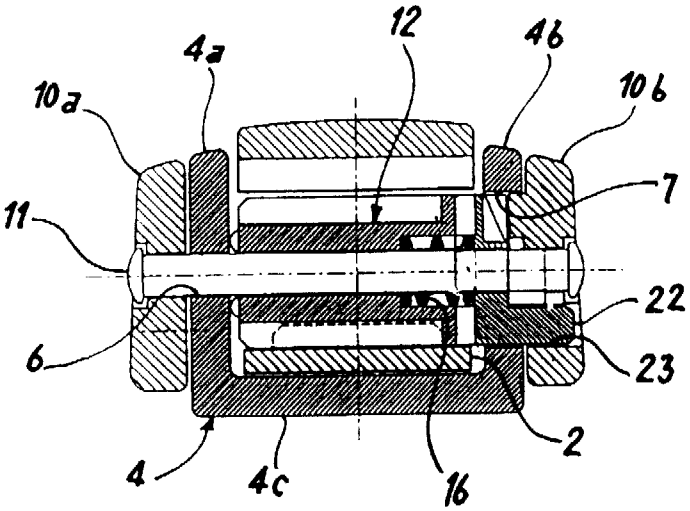

By rotating the lever 8 in the sense of arrow C between the position of FIG. 8 and that of FIG. 9, the peg 22 is moved between the longitudinally opposing ends of the slot 23, permitting a relative rotation of the lever 8 with respect to the flange 14 equal to the permissible travel for the extent of the slot 23.

The rotation of the flange 14 is impeded by the engagement of the peg 22 with the free end of the sprung element 24. Owing to the relative rotation between the lever and the flange, the ramp 18 of the cam 17 is caused to slide onto the counter-ramp 20 in order to bring the coupling elements 13, 15 into mutual engagement (FIG. 7) against the action of the spring 16.

By further rotation of the lever 8 in the sense of arrow C, the sprocket wheel 12 is caused to rotate about the axis of the pivot pin 11, in the sense of arrow D, integrally with the flange 14 which is in its turn driven by the lever by means of the peg 22.

This rotation brings about the desired sliding of the strap 2 in the direction of arrow E. It will be noted that, when the lever is returned to the non-operative position of FIG. 1, in the opposite sense to that of arrow C, the cam 17 is again received in the recess between the counter-ramp 20 and the shoulder 21, with the consequent mutual uncoupling of the coupling elements 13, 15. After this uncoupling, the sprocket wheel 12 is idle about its axis and the ratchet 3 is held in the position reached by the pawl 26. By repeating the operation, the two footwear portions A, B are closed on one another with the desired fastening tension.

In order to ease this tension, it is necessary only to exert pressure on the control appendage 28 of the pawl 26 in such a manner as to disengage it from the ratchet 3. The sliding of the ratchet in the opposite direction to that of arrow E, no longer opposed by the pawl 26, causes the sprocket wheel 12 to rotate about its axis.

FIGS. 10 to 14 illustrate a second embodiment of the fastening device of this invention generally indicated 100.

Details analogous to those of the preceding example have been given the same reference numerals.

The device 100 comprises a lever 108 having a control appendage 109 and two parallel arms 110a,b. The lever 108 is pivoted by means of its arms 110*a,b* on a pivot pin 111 extending through holes 106, 107.

Extending from the inner side of the arm 110*a* is a cylindrical appendage 114 which is arranged in the hole 107 and has a toothed portion constituting a first coupling element 113 having front teeth.

A sprocket wheel 112 is also rotatably supported on the pivot pin 111 and has at its axial end facing the element 113 a second coupling element 115 having front teeth which is capable of engaging with the element 113. The toothed portion of the coupling elements has a saw-tooth profile so that the elements tend to become uncoupled from one another axially in one of the two senses of relative rotation while they remain mutually coupled in the opposite sense, thus forming a unidirectional retaining means.

The sprocket wheel 112 is rotatably supported on the pivot pin 111 and abuts a shoulder 111*a* of the same under the action of a spring 116 acting between the sprocket wheel 112 and the wing 104*a* of the base 104.

Figure 12:
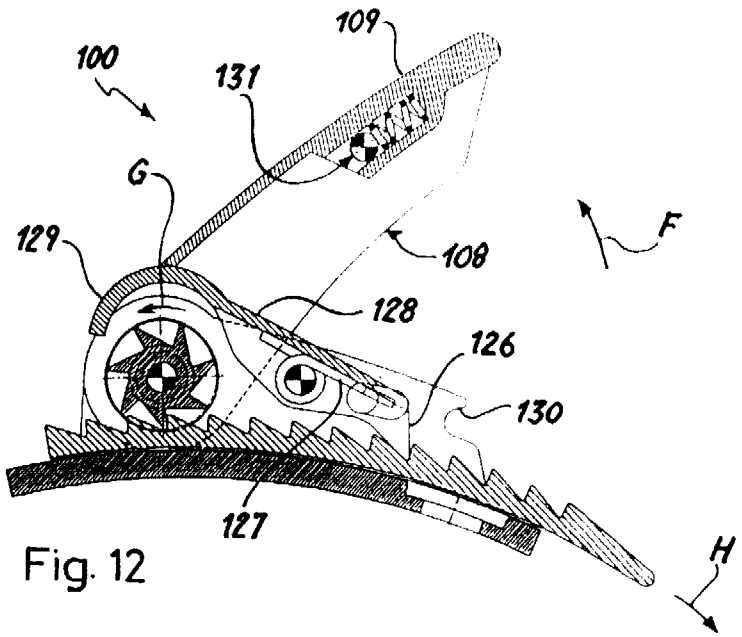
FIG. 12 is a view corresponding to that of FIG. 11 after partial movement of the lever towards the operative position.
Figure 14:
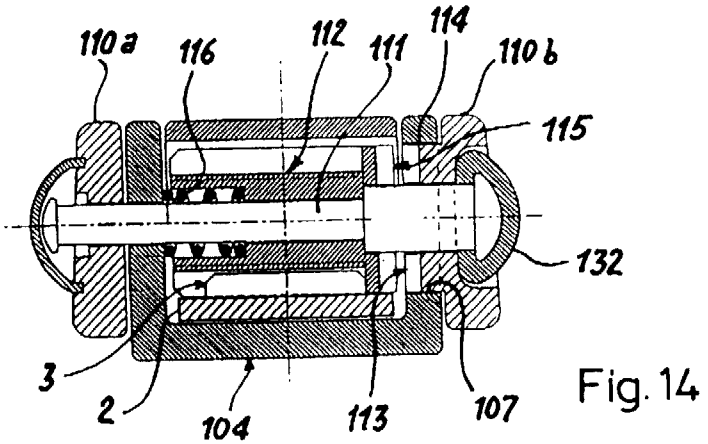
FIG. 14 is a front sectional view of the device of FIGS. 10 to 13 with the fastening released.
Figure 11:
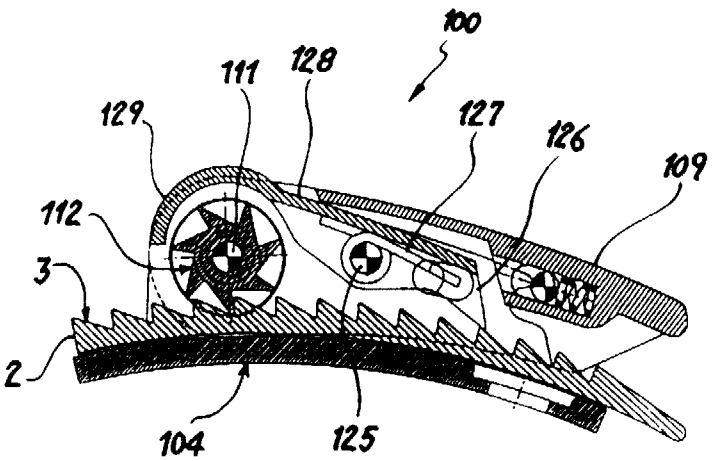
FIG. 11 is a cross-sectional view of the device of FIG. 10 with the lever close to the non-operative position.
Figure 13:
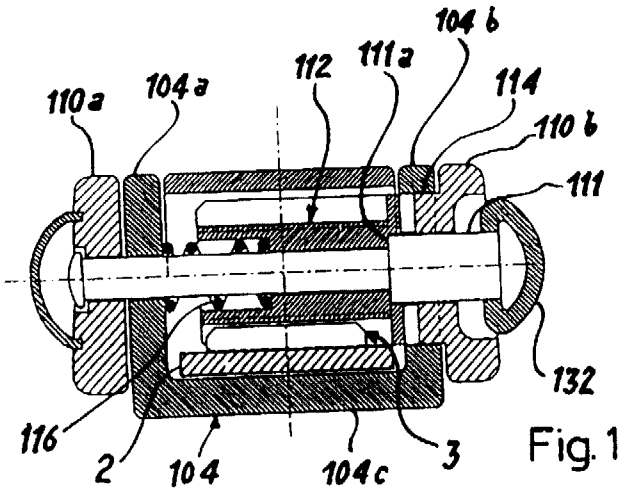
FIG. 13 is a front view of the fastening device in the position of FIG. 11.

The sprocket wheel 112 is consequently caused to rotate about the axis of the pivot pin 111 integrally with the lever 108 by operation of the lever in the direction and sense of arrow F in FIG. 12, while it remains idle when the lever is returned to the non-operative position of FIG. 11, in the opposite sense to that of arrow F. A pawl 126, which is resiliently urged by a spring 127 into engagement with the teeth of the ratchet 3, is also pivoted between the wings 104*a,b* of the base 104 by means of a pivot pin 125.

The pawl 126 comprises a control appendage 128 which is lengthened into a tongue 129 of transparent material extended to protect the sprocket wheel 112 which is partially covered thereby.

The position of the pawl 126 on the base 104 and of the pivot pin 125 thereof is such that the control appendage 128 of the pawl 126 co-operates with the control appendage 109 of the lever 108 when the latter is in the non-operative position. As a result of this co-operation, the pawl swings out of engagement with the ratchet 3 when the lever is near the base 104.

The lever 108 is maintained in the released state while in the non-operative position owing to the coupling engagement between an appendage 130 of the base 104 and a sprung coupling device 131 of said lever 108.

The device 100 operates in the following manner. The strap 2 is inserted with the ratchet 3 between the central portion 104*c* of the base 104 and the sprocket wheel 112. By operating the lever 108 one or more times in the sense of arrow F, the sprocket wheel is rotated in a corresponding manner about the axis of the pivot pin 111 in the sense of arrow G in FIG. 11; this rotation causes the desired sliding of the strap 2 in the direction of arrow H. Thus the two footwear portions A, B are closed on one another at the desired fastening tension.

It will be noted that, during the return run of the lever towards the non-operative position, the coupling elements 113, 115 are mutually uncoupled owing to the effect of the saw-tooth profile of the respective toothed portions.

The inclination of the sides of the saw-tooth profile creates an axial force on the sprocket wheel 112 capable of overcoming the force of the spring 116.

The lever 108 can thus rotate relative to the sprocket wheel 112 while the ratchet 3 is held in position by the pawl 126 which is urged into engagement with the toothed portion of the same.

Once the desired fastening has been obtained, the lever is folded back into the non-operative position, held in coupling engagement on the base 104, and the pawl 126 is consequently swung out of engagement with the toothed portion of the ratchet.

In order to ease the fastening, pressure is exerted on the top 132 of the pivot pin 111 against the action of the spring 116 in order to move the sprocket wheel 112 axially away from the appendage 114 and consequently to uncouple the coupling elements 113, 115. This, the sliding of the ratchet in the opposite direction to that of arrow H is no longer opposed and the sprocket wheel 112 is caused to rotate freely about its axis in the opposite sense to that of arrow G.

Figure 15:
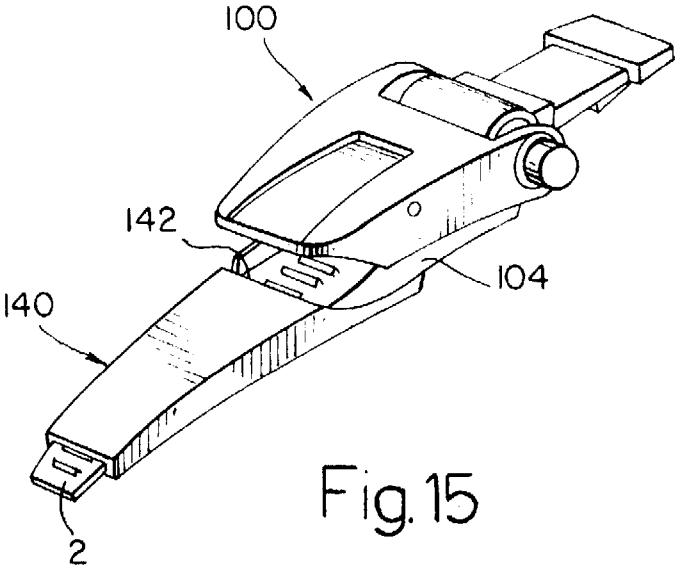
FIG. 15 is a perspective view of the device of FIGS. 10 to 13 provided with an attachment.
Figure 16:
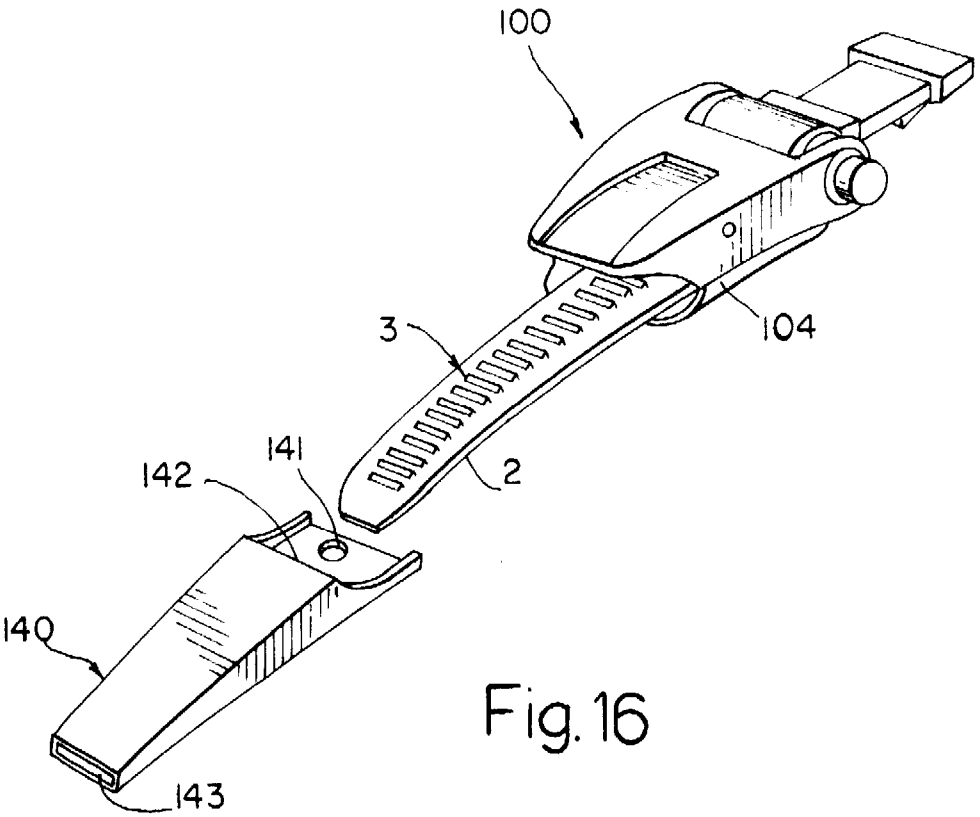
FIG. 16 is a perspective view of the device and attachment of FIG. 15 in the separated state.

FIGS. 15 and 16 show an attachment of the device 100 comprising a sheath 140 which is to receive the strap 2 in its interior, at least partially. The sheath is provided with a hole 141 for securing by means of a rivet or a similar means to the footwear. The hole 141 is preferably coaxial with the hole provided on the central portion 104*c* of the base 104 so as to be secured together with the base to the corresponding footwear portion. The sheath 140 has a mouth 142 for insertion of the strap 2, and an internal opening 143 which is elongate in shape. The opening 143 is shaped in such manner as to fit the strap 2 with reduced play, when the device 100 is in use, and thus to protect the toothed portion of the ratchet 3 from any deposits of mud, earth or dirt generally.

The invention thus achieves the proposed aims as well as numerous advantages, including a reduction in the space requirement, low production and assembly costs, improved reliability and structural strength.

What is claimed is:

1. An adjustable fastening device for sports footwear, for closing with respect to one another two footwear portions (A,B) that can be moved relative to one another, comprising:

a ratchet (3) that is to be secured to one of the footwear portions, a base (4; 104) that is to be secured to the other of the footwear portions, the ratchet being slidable in a predetermined direction with respect to the base, a sprocket wheel (12; 112) supported on the base (4; 104) to be rotatable about an axis that is substantially perpendicular to the sliding direction of the ratchet (3), the sprocket wheel being in meshing engagement with the ratchet, a lever (8; 108) mounted on the base so that it can be swung about the axis of the sprocket wheel, first unidirectional retaining means between the lever (8; 108) and the sprocket wheel (12; 112) for the rotation of the sprocket wheel and the resultant sliding in one direction of the ratchet (3) as a result of the swinging of the lever (8; 108) into an operative position, second unidirectional retaining means for holding the ratchet (3) with respect to the base (4; 104) in the opposite direction to the sliding direction, characterised in that the first unidirectional retaining means comprise a coupling comprising first and second coupling elements coaxial with said sprocket and having axially directed teeth (13; 15; 113, 115) which coupling acts between one axial end of the sprocket wheel (12; 112) and the lever (8; 108).

2. A device according to claim 1, wherein the coupling can be uncoupled selectively.

3. A device according to claim 2, wherein, said elements first and a second coupling element (13, 15) include; respectively, a first and a second toothed portion respectively arranged on the sprocket wheel (12) and on a flange (14) interposed between the sprocket wheel (12) and the lever (8).

4. A device according to claim 3, wherein cam means (17) for causing the elements of the coupling (13, 15) to couple as a result of a partial rotation of the lever (8) are interposed between the flange (14) and the lever (8).

5. A device according to claim 4, wherein the cam means (17) comprise a ramp (18) on the lever (8), a counter-ramp (20) on the flange (14) and means (22, 23) for driving the flange (14) in order to cause the flange to rotate about the axis of the sprocket wheel (1).

6. A device according to claim 3, wherein there are provided resilient means (16) that act on the flange to urge the coupling elements to become uncoupled from one another.

7. A device according to claim 3, wherein the coupling elements (13, 15; 113, 115) have a saw-tooth profile.

8. A device according to claim 3, wherein the coupling elements (13, 15; 113, 115) comprise respective toothed rings extending coaxially with the pivot axis of the sprocket wheel (12; 112).

9. A device according to claim 3, wherein the base (4) is substantially U-shaped with a pair of wings (4*a*,*b*) on which are pivoted the sprocket wheel (12), the lever (8) and the flange (14), the lever (8) has a pair of arms (10*a*,*b*) by means of which the lever is pivoted on the base (4), the arms are arranged on the outside of the wings and one of the winds has an opening (7) which is coaxial with the pivot axis of the lever (8) and of the sprocket wheel (12) and through which the flange (14) can be moved axially for mutual engagement with the coupling elements (13, 15).

10. A device according to claim 1, wherein the second unidirectional retaining means comprise a sprung pawl (26; 126) pivoted on the base (4; 104).

11. A device according to claim 10, wherein the pawl (126) has a control appendage (128) arranged in such a manner as to co-operate with the lever (108), when the latter is folded back onto the base (104) into a non-operative position, in order to disengage the pawl (126) from the ratchet (3).

12. A device according to claim 11, wherein the control appendage (128) of the pawl is lengthened into a tongue (129) extended to cover the sprocket wheel (112) partially.

13. A device according to claim 12, wherein the tongue (129) is produced from transparent material.

14. A device according to claim 11, wherein there are provided means for coupling of the base (104) and the lever (108) when the lever is in the non-operative position.

15. A device according to claim 11, wherein the pawl (26) is resiliently urged into a state of engagement with the ratchet (3), the sprocket wheel (12) being mounted idly with respect to the lever (8) when the lever is in the non-operative position, the pawl (26) having a control appendage (28) for swinging the pawl with respect to the base (4) into a state of disengagement from the ratchet (3).

16. A device according to claim 11, wherein the pawl (26; 126) and the lever (8; 108) are pivoted on the base (4; 104) with pivot axes spaced apart from one another in such a manner that the space requirements of the pawl and the lever overlap at least partially when the lever (8; 108) is in a non-operative position near the base (4; 104).

17. A device according to claim 1, comprising a sheath which is to receive the ratchet in its interior, at least partially.

18. A device according to claim 17 in which the sheath is provided with a hole for securing together with the base to the corresponding footwear portion.

* * * * *

UNITED STATES PATENT AND TRADEMARK OFFICE

CERTIFICATE OF CORRECTION

PATENT NO. : 5,745,963

DATED : May 5, 1998

INVENTOR(S) : Graziano Nicoletti

It is certified that error appears in the above-identified patent and that said Letters Patent is hereby corrected as shown below:

On the Title Page:

Item [75]

Delete "Nicoletti Graziano" and insert --Graziano NICOLETTI--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*